US005788929A

United States Patent [19]

Nesti

[11] Patent Number: 5,788,929

[45] Date of Patent: Aug. 4, 1998

[54] SAMPLE TEMPERATURE PROTECTION RACK

[76] Inventor: Edmund D. Nesti, 1 Nesti Blvd., Shelburne, Vt. 05482

[21] Appl. No.: 614,213

[22] Filed: Mar. 12, 1996

[51] Int. Cl.[6] ..... B01L 9/00

[52] U.S. Cl. ..... 422/104; 422/99; 422/100; 422/102; 436/180; 435/290.1

[58] Field of Search ..... 422/99–104; 206/563, 206/564, 565; 436/180, 809; 435/290.1

[56] References Cited

U.S. PATENT DOCUMENTS

| | | | |
|---|---|---|---|
| 4,246,339 | 1/1981 | Cole et al. | 435/7 |
| 4,483,925 | 11/1984 | Noack | 435/293 |
| 4,902,481 | 2/1990 | Clark et al. | 422/101 |
| 4,950,608 | 8/1990 | Kishimoto | 435/290 |
| 4,985,207 | 1/1991 | Hayashi | 422/102 |
| 5,035,866 | 7/1991 | Wannlund | 422/102 |
| 5,318,753 | 6/1994 | Honda | 422/104 |
| 5,587,321 | 12/1996 | Smith et al. | 435/305.3 |

*Primary Examiner*—Harold Y. Pyon
*Attorney, Agent, or Firm*—Thomas N. Neiman

[57] ABSTRACT

The sample temperature protection rack is designed to provide a holding area for enzymes and other compound samples and, at the same time maintain a pre-determined temperature range that prevents rapid degradation of the sample. The apparatus consists of a compact sample tube rack that contains coolant surrounded by a hard plastic shell. It has a removable thin plastic cover that is autoclavable to minimize the risk of sample contamination and can be disposable. The shell incorporates a tongue and groove system to allow for multiple units to be positioned together. The rack contains a plurality of rows of slots which will accommodate sample tubes and will accommodate variable sized tubes.

3 Claims, 3 Drawing Sheets

SAMPLE TEMPERATURE PROTECTION RACK

BACKGROUND OF THE INVENTION

This invention pertains to laboratory devices, and in particular, to such a laboratory device that is designed to be used on a laboratory bench to maintain enzymes and other sensitive compounds within a temperature range that prevents them from rapid degradation.

It is common to have a large and bulky low temperature polyurethane foam or polypropylene storage units which cannot be autoclaved and have limited capacity. Also, it is common to use an ice bucket to which the tubes are transferred from the refrigerator to a standard tube rack and back to the ice bucket. There are a number of units based upon the above identified small racks and the like. It is inconvenient to use such systems because of the time it takes to transfer tubes. Also inconvenient are currently available low temperature storage units which accommodate few samples. What is needed is a sample storage rack which maintains a consistent temperature and provides a compact, portable unit that can be easily manufactured and have the ability to be expanded for however many sample tubes are required. It is another object of this invention to provide an apparatus that can be stored in the refrigerator or freezer and then be transferred directly to the bench and safely used without the necessity of removing the tubes from the rack.

It is the object of this invention to teach a sample temperature protection rack which avoids the disadvantages and limitations, recited above of previous sample storage systems.

SUMMARY OF THE INVENTION

Particularly, it is the object of this invention to teach a sample temperature protection rack, for use in laboratories in order to keep reagents cool while on the bench, comprising a housing frame; said housing frame comprising a rigid shell for providing protection of a sample being maintained; said rigid shell having a base portion; said rigid shell further having a plurality of vertical sides; said housing frame further having a replaceably attachable cover means; rack means for being positioned within said housing frame; said rack means having internal bladder means for holding a coolant mixture; and said rack means further having a plurality of tube receiving slots positioned therein for the holding of said tubes in order to maintain a desired temperature within said tubes.

BRIEF DESCRIPTION OF THE INVENTION

Further objects and features of this invention will become more apparent by reference to the following description taken in conjunction with the following figures, in which.

DESCRIPTION OF THE PREFERRED EMBODIMENTS

Figure 1:
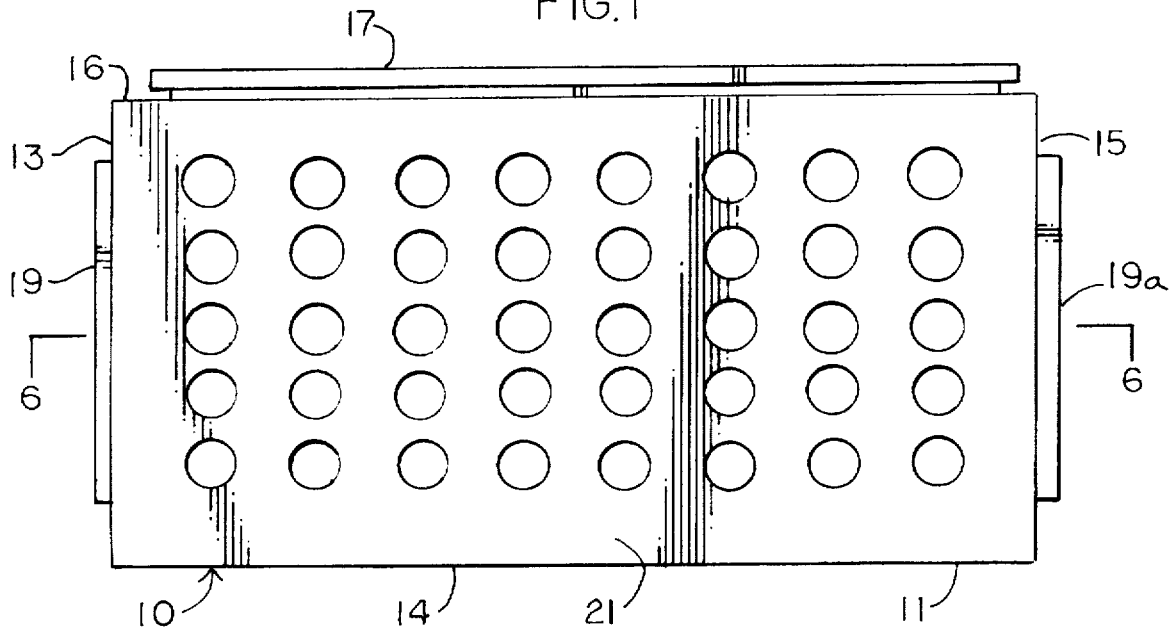
FIG. 1 is a top plan view of the novel sample temperature protection rack.
Figure 2:
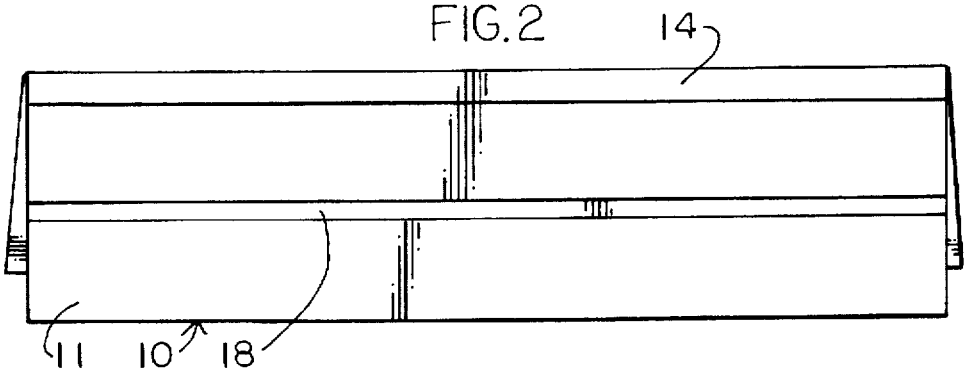
FIG. 2 is right side elevational view thereof.
Figure 3:
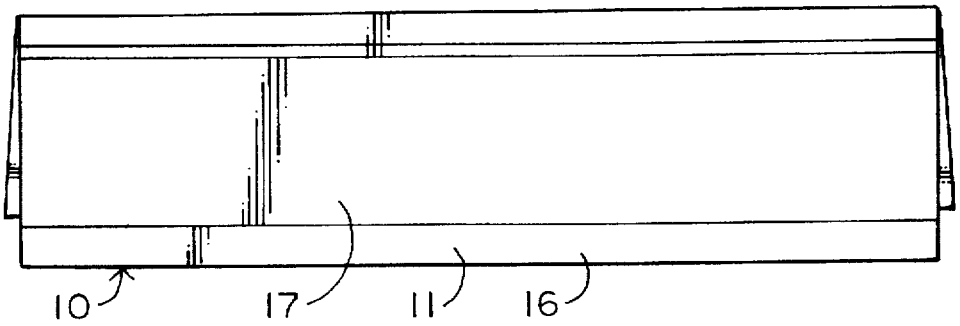
FIG. 3 is a left side elevational view thereof.
Figure 4:
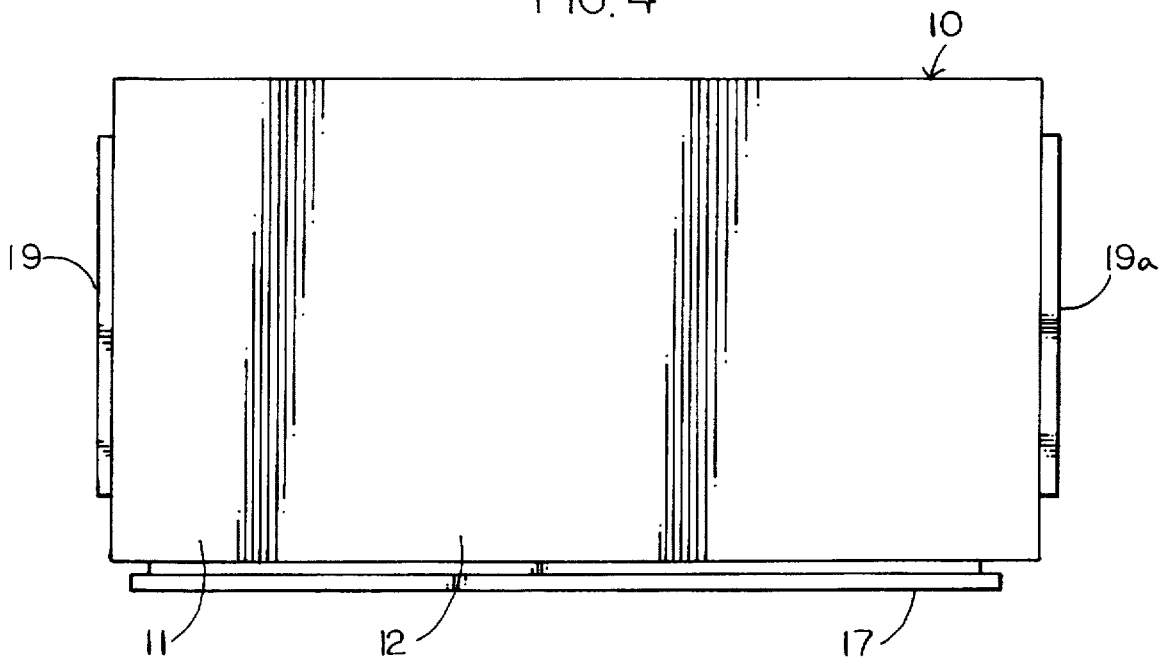
FIG. 4 is a bottom plan view thereof.
Figure 5:
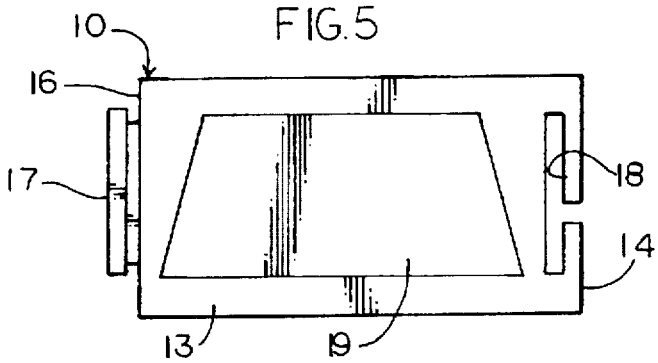
FIG. 5 is a front elevational view thereof.
Figure 6:
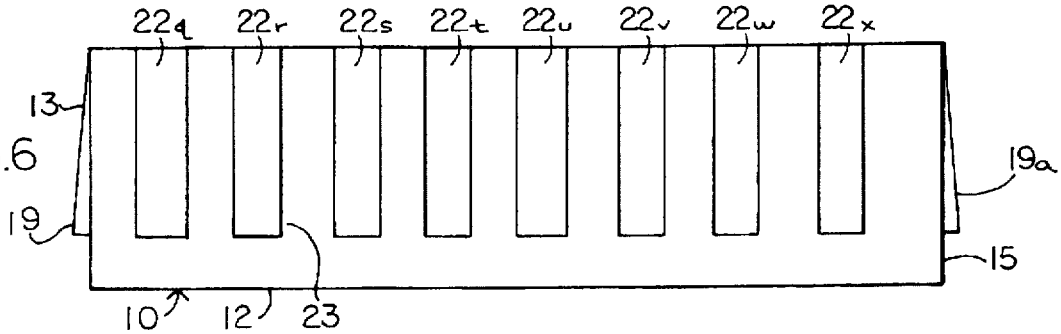
FIG. 6 is a cross-sectional view taken along line 6—6 of FIG. 1.
Figure 7:
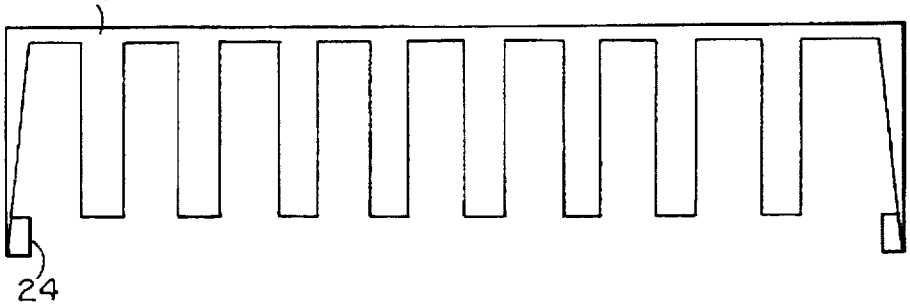
FIG. 7 is a side elevational view of the novel cap of the rack.

As shown in the figures, the novel sample temperature protection rack 10 comprises a housing 11 having a base portion 12 and four vertical sides 13, 14, 15 and 16. The housing is constructed of rigid plastic and has a tongue shaped fastening unit 17 on side 16. A receiving groove 18 is present on the opposite side 14. This design allows the apparatus to be connected together to provide as many units as necessary depending on the number of tubes involved. On the other two sides 13 and 15 of the housing 11 are projections 19 and **19*a* which function as a receiving mechanism in order to lock the top cover 20 on the apparatus 10**.

A rack 21 having a plurality of tube receiving slots 22 through **22*mm* fits within the housing 11. The tube receiving slots 22 through 22*mm* are designed to accept sample tubes from 0.5 milliliter to 1.5 milliliters. An internal bladder 23 contains a coolant mixture which surrounds the tube receiving slots 22 through 22*mm* to keep the sample tubes and their contents at a level temperature in order not to have the samples deteriorate quickly. The cap 20 is a thin plastic material having apertures which correspond to the tube receiving slots. The cap has locking snaps 24 and 24*a* which fit over projections 19 and 19*a* to hold the cap 20** in position and the cap is designed to be autoclavable in order allow for minimization of the potential for contamination. The cap may also be designed to be disposable in order to minimize contamination.

In operation, the sample temperature protection rack eliminates a number of problems. It is a small unit and can easily be expanded by linking a number of the units together by means of the tongue and groove design connectors. Therefor, no matter how large the experiment and no number of sample tubes required, this device can handle the job. Additionally, the samples can be stored in the freezer or refrigerator in the racks and then be moved directly to the bench and no removal of the individual tubes is necessary. The rack is the same size as standard sample racks which makes positioning particularly simple. Additionally, being able to autoclave the cap reduces the risk of contamination of the samples. Also, the removable cap increases the length of time the tubes can be kept cool and placing it in a new rack fresh from the freezer.

While I have described my invention in connection with specific embodiments thereof, it is clearly to be understood that this is done only by way of example and not as a limitation to the scope of my invention as set forth in the objects thereof and in the appended claims.

I claim:

1. A sample temperature protection rack, for use in laboratories in order to keep reagents below ambient air temperature while on a bench, comprising:

a housing frame;

said housing frame comprising a rigid shell for providing protection of a sample being maintained;

said rigid shell having a base portion;

said rigid shell further having a plurality of vertical sides;

one of said vertical sides of said rigid shell having a tongue shaped extension for sliding therein in adjacent housings;

the vertical side opposite said tongue shaped extension having a tongue shaped receiving groove located therein;

said housing frame further having a replaceably attachable cover means;

rack means for being positioned within said housing frame;

said rack means having permanently sealed internal bladder means for holding a coolant mixture;

said rack means further having a plurality of tube receiving slots positioned therein for the holding of said tubes in order to maintain a desired temperature within said tubes; and said permanently sealed internal bladder means of said rack means comprises a means for holding said coolant at a pre-determined level adjacent to the sides of the sample tubes held in said tube receiving slots in said rack means.

2. A sample temperature protection rack, according to claim 1, wherein:

said rigid shell of said housing frame comprises a unit constructed of a plastic material.

3. A sample temperature protection rack according to claim 1, wherein:

said replaceable attachable cover means comprises a plastic cap;

said plastic cap having apertures located therein which correspond with said tube receiving slot in said rack means;

said plastic cap further having extension snaps for attaching said plastic cap to said rigid plastic shell;

said plastic cover comprises autoclavable means for minimizing contamination of the sample material being held in said sample temperature protection rack apparatus; and said plastic cover further comprises disposable means.

* * * * *